US006458040B1

(12) United States Patent
Veazie, III

(10) Patent No.: US 6,458,040 B1
(45) Date of Patent: Oct. 1, 2002

(54) GOLF SWING TRAINING DEVICE

(76) Inventor: Waldemar Veazie, III, 905 SW. Lighthouse Dr., Palm City, FL (US) 34990

( * ) Notice: Subject to any disclaimer, the term of this patent is extended or adjusted under 35 U.S.C. 154(b) by 0 days.

(21) Appl. No.: 09/546,746

(22) Filed: Apr. 11, 2000

Related U.S. Application Data

(60) Provisional application No. 60/183,412, filed on Feb. 28, 2000.

(51) Int. Cl.[7] ..... A63B 69/36
(52) U.S. Cl. ..... 473/268; 473/309
(58) Field of Search ..... 473/131, 139–147, 473/150–152, 198–200, 207–211, 219–222, 266–268, 409; 434/247, 252

(56) References Cited

U.S. PATENT DOCUMENTS 3,524,650 A * 8/1970 Barthol
3,622,159 A * 11/1971 Morton
4,000,904 A * 1/1977 Poortman
5,632,688 A * 5/1997 Blaakman

* cited by examiner

*Primary Examiner*—Mark Sager
(74) *Attorney, Agent, or Firm*—Law Offices of Royal W. Craig

(57) ABSTRACT

A device in the general size and shape of a golf tee, which contains sensing circuitry to detect the sound of the contact of the club head with the ball, or with the playing surface. This stimulus activates a timer, which in turn activates illumination device in the forth of a light pulse directed at the face of the golfer. By physical proximity to the target of the club head the golfer will perceive illumination of the device in his/her peripheral vision when the golfer has maintained eye contact with the target at the instant of contact.

15 Claims, 11 Drawing Sheets

GOLF SWING TRAINING DEVICE

The present application is derived from Provisional Patent Application Serial No. 60/183,412 for "(GOLF SWING TRAINING DEVICE", filed: Feb. 28, 2000 by Veazie, Waldemar.

BACKGROUND OF THE INVENTION

1. Field of the Invention

The present invention relates to sports conditioning, and in particular, to a compact and portable device that uses an audio sensor, timer, and an illumination device to provide positive visual feedback to a golfer for the purpose of improving the golf swing.

2. Description of the Background

It is a primary goal of golfers at any level of ability, to maintain a fluid and balanced body position throughout the swing. Most teaching professionals in the sport of golf advocate a steady head position during the initial portion of the golf swing through club contact with the ball. The steady head position is generally taught by instructing the golfer to focus his or her eyes on the ball during the backswing, the downswing, and through ball contact. The golfer is encouraged to maintain eye contact with the target until the club face has completed its contact and the ball has begun its trajectory.

Unfortunately, it is very difficult for the eyes to register the precise moment of the disappearance of the ball, and this creates an overriding tendency to try to follow the ball to see where it went. This, of course, interrupts the fluidness of the swing and often results in poor shot making. This undesirable result is commonly referred to as "coming off the ball."

In many cases the habit of "coming off the ball" is corrected by the persistent assistance of another party, such as a golf instructor, during a lesson or a practice session on the golf driving range. The instructor or other person reminds the golfer to keep his or her head down, monitors the swing, and informs the golfer that he or she has looked up, and so forth. Over time the golfer becomes conditioned to keep his or her head down with respect to the ball. Unfortunately, a large amount of repetition is necessary for this, and an instructor is not typically available to provide such a long interval of instruction.

Developing and retaining the correct posture and movement, commonly referred to as developing "muscle memory", can be a long process. Unlike professional golfers who have the time and resources to procure extensive teaching assistance, most amateur or recreational golfers must rely on self-teaching practice. It would therefore be desirable to provide a device that automatically reinforces the correct head-down position throughout the swing in a way that can supplement traditional instruction, and which the golf student can take away from the lesson to prevent the loss of the muscle memory.

A proper golf swing will now be described with reference to FIGS. 1 through 3.

FIG. 1 portrays a golfer in the head-down position just prior to commencing the back swing, commonly known as "addressing the ball." It is desirable for the golfer to remain focused along a line X that generally follows the shaft of club C to the ball B.

FIG. 2 portrays a golfer in the same stage of addressing the ball, from the point of view directly behind the golfer in the direction of the desired trajectory of the ball. Again, despite a slight drop of the rear shoulder with respect to the waist and feet, it is desired for the head to follow the line X through to the position of the ball.

FIG. 3 portrays a golfer in a mid-swing position from the same perspective as FIG. 2, where the ball has just left the club and is beginning its trajectory. The golfer has employed his hips and upper body to contribute to the power of the stroke, as shown by the lifting of the rear foot and the turning of the hips. Despite this, the head remains down and the focus of the eyes is, for the moment, squarely on the target along line X. This golfer exhibits the intended proper posture and head and neck position just after contact. However, as described above, and especially with the hips and upper body turning, even a steadfast intention to keep one's head down is easily derailed when it comes to golf.

There have have been a few prior devices that attempt to condition a golfer into keeping their head down. At least one of these does this by emitting a signal triggered by the audio detection of the club head impact. Specifically, U.S. Pat. No. 5,993,323 to Linenfelser discloses an apparatus which attaches to the hat of the golfer. The sound of the contact between the ball and the club triggers a circuit that activates an audible alarm when the head of the golfer moves improperly. The device requires the golfer to wear a heavily modified baseball-style cap.

The foregoing and most other prior art devices employ negative feedback—that is, they trigger when an improper position is achieved instead of the proper position. This is much less effective in helping to improve the swing because it does not reinforce the proper position, but merely creates an awareness of the improper position. Furthermore, many such devices use sound as a stimulus and this is less effective because golfers primarily use visual cues to evaluate and adjust swing characteristics. It is much more desirable to provide a positive, visual stimulus.

A few known devices use illumination as a visual stimulus for the purpose of improving a golf swing. For example, U.S. Pat. No. 5,919,098 to Salmon discloses a light source that attaches to the shaft of a golf club and directs a beam towards the eyes of the golfer. As the golfer swings the club, the path the club follows is illuminated. This illuminated path can be compared to an indicia placed on the playing surface. Devices of this category require attachment of at least part of the apparatus to the golf club. This is highly undesirable because even a small change in the weight, weight distribution, stiffness, or air resistance of a golf club can have a profound effect on the feel of the swing. Also, graphite golf club shafts can be damaged by the application of a concentrated force in the manner that these prior art devices are attached to the circumference of the club shaft. Use of these devices would then likely entail the purchase of additional clubs that must be carried in the golf bag. It is more desirable for a device that suggests proper configuration of the head to be compact, portable, and self-contained.

Also relevant in the prior art are mechanical devices that compel the proper position of the head by restricting the movement of the golfer. By way of example, U.S. Pat. No. 5,746,663 to Calace discloses a mouthpiece attached to a rigid frame, which is in turn attached to a tether which is fastened to the belt or waistband of the golfer. The golfer bites down on the mouthpiece while the frame and the tether act to prevent the movement of the head of the golfer. More than a few golfers would find such a device uncomfortable and unduly complicated.

It is important to note that all of the above-described prior art devices must be worn by the golfer or applied to his or her equipment. Such devices are not generally allowed during non-practice play. Consequently, the golfer is required to adjust his or her swing routine to compensate for the absence of the prior art devices during regulation play.

It should be greatly advantageous to provide a device which is economical and portable enough to fit in the golfer's pocket or bag, which can be used to condition the proper position of the golfer's head using positive visual feedback. It would be of further benefit to provide a device as described above which can be used without change or modification of the golfer's apparel, and which requires no swing adjustments when in use.

SUMMARY OF THE INVENTION

It is therefore an object of the present invention to provide a means for delivering positive feedback, in the form of a pulse of directed light, to a golfer who achieves proper head position during the contact portion of the golf swing.

It is a further object of the present invention to deliver a positively reinforcing pulse of directed light to a golfer that is visual in character, and emanating from a point located in proximity to the desired focus of the golfer, which is on the target.

It is a further object of the present invention to provide a means for delivering positive feedback to a golfer that is compact and portable, so that it may be easily carried and used on the golf course and at the driving range.

It is a further object of the present invention to provide a golf swing training device that is small and unobtrusive, and that has no negative impact on the speed of play or etiquette of the sport.

These and other objects are accomplished by the provision of a device in general size and shape of a standard golf tee that can be easily inserted in the ground, which contains a sensing circuit that detects the sound of the contact of the club head with the ball and/or playing surface. The sensing circuitry processes the audio signal created the sound of impact (or alternatively, the visual motion at the point of impact) and sends an electrical signal to a timer. The timer immediately triggers an indicator circuit and counts off a brief delay during which it maintains illumination. The indicator circuit is preferably a limited-field-of-view visual indicator, to provide visual feedback to the golfer shortly after said impact. All components and circuitry are contained in a compact tee-shaped housing adapted for easy placement by the golfer on the ground before the swing.

The golfer is earlier-advised to place the device on the ground near the golf ball (opposite side of the golf hall from the golfer's position) with the receiver pointed at the golf ball and the visual indicator pointed generally at the golfer's head position during the swing. Prior to and during the swing the golfer focuses on the target (ball, playing surface, or device) as proper swing technique requires. However, when the club head makes contact the golfer can see the visual indicator illuminate for a brief period within the field of view of his eyes. The visual indicator can only be perceived by the golfer in his/her peripheral vision if his/her eyes (and therefore his/her head) has maintained the desired head position relative to the target. Conversely, if the eyes move prematurely from the target during the swing then the indicator illumination will not be perceived by the golfer.

BRIEF DESCRIPTION OF THE DRAWINGS

Other objects, features, and advantages of the present invention will become more apparent from the following detailed description of the preferred embodiment and certain modifications there of when taken together with the accompanying drawings in which.

DETAILED DESCRIPTION OF THE PREFERRED EMBODIMENTS

Figure 1:
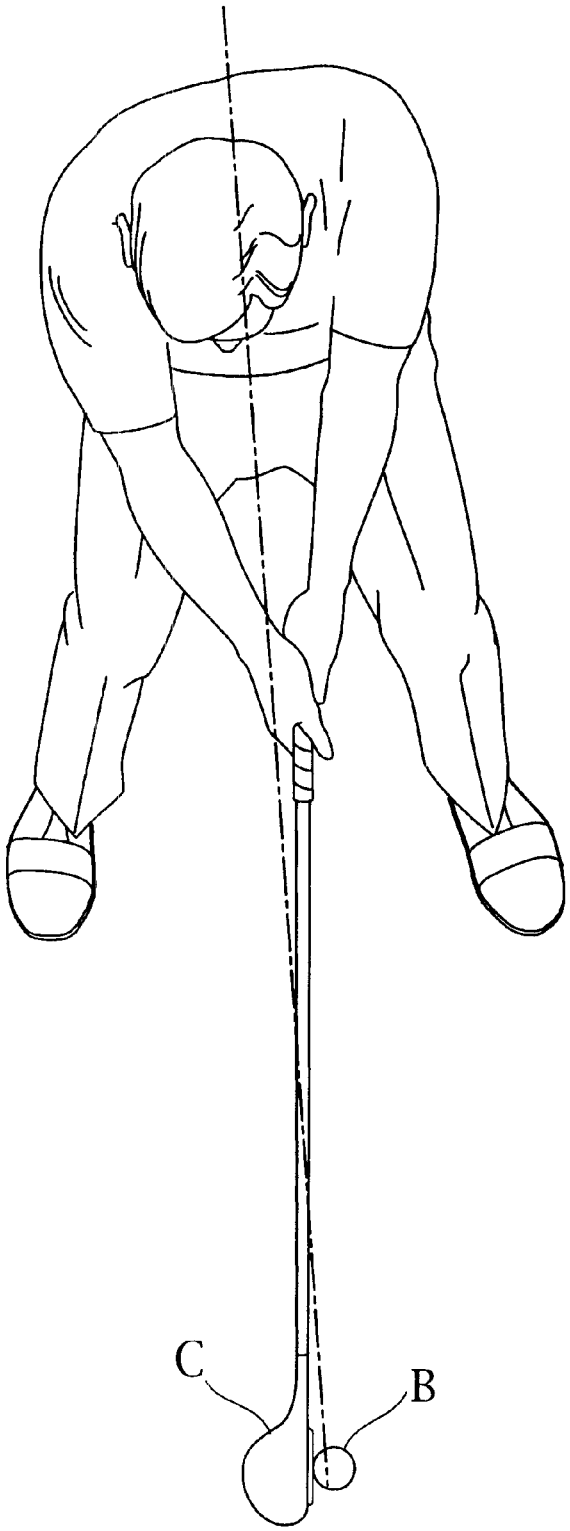
FIG. 1 is a top view rendering of a golfer in the position of addressing the ball, showing a preferred configuration of the golfer with respect to the present invention when in use.
Figure 2:
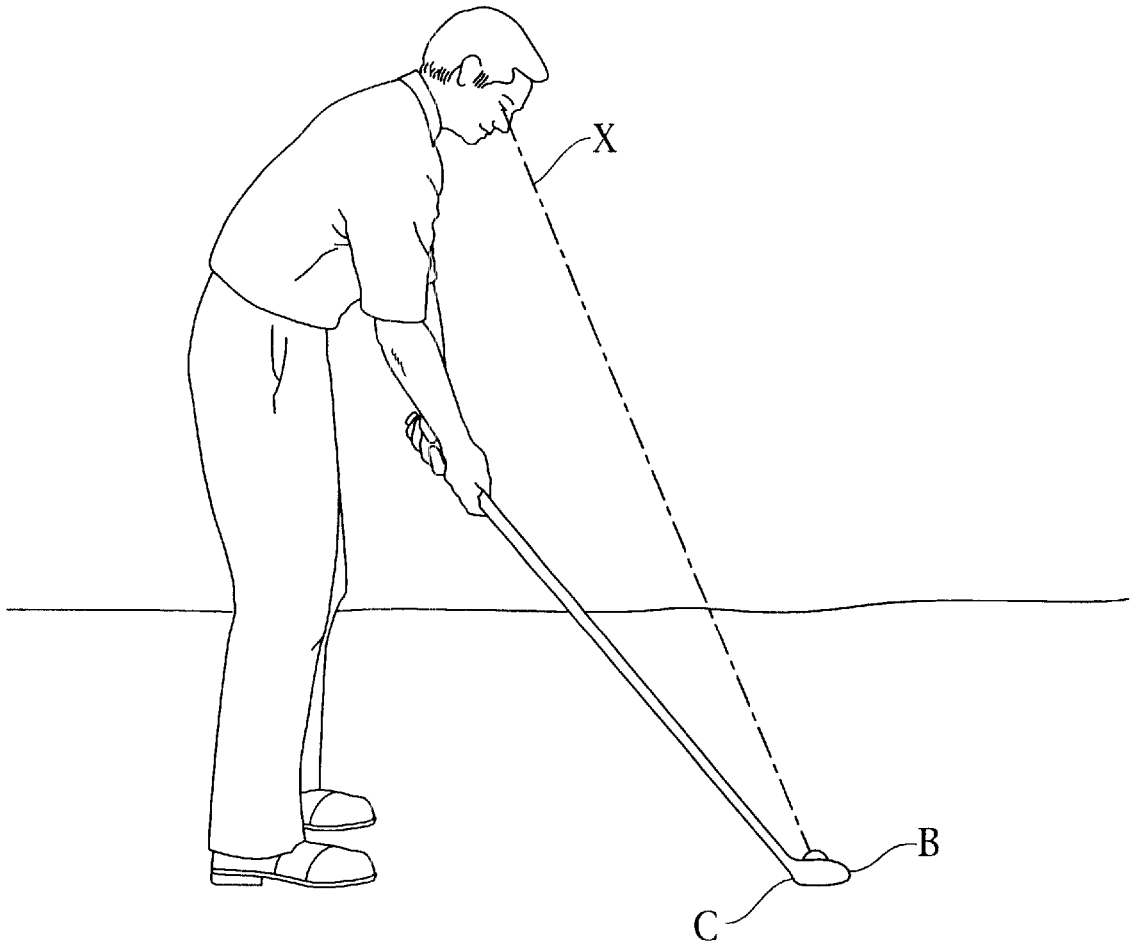
FIG. 2 is a plan view rendering of a golfer in the position of addressing the ball, showing the preferred configuration of FIG. 1.
Figure 3:
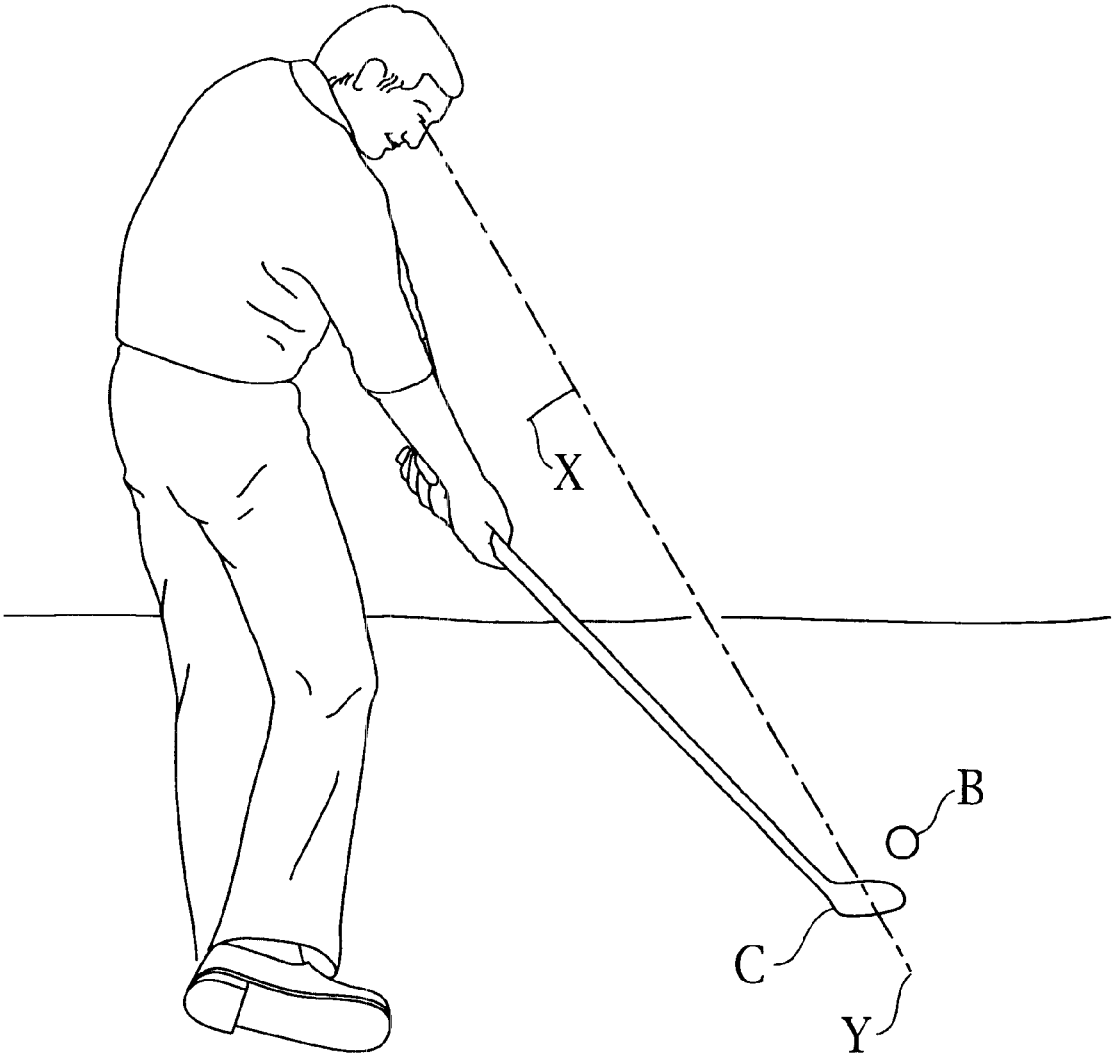
FIG. 3 is a plan view rendering of a golfer in the position of the early portion of the follow through, showing a preferred configuration of the golfer with respect to the present invention when in use.
Figure 4:
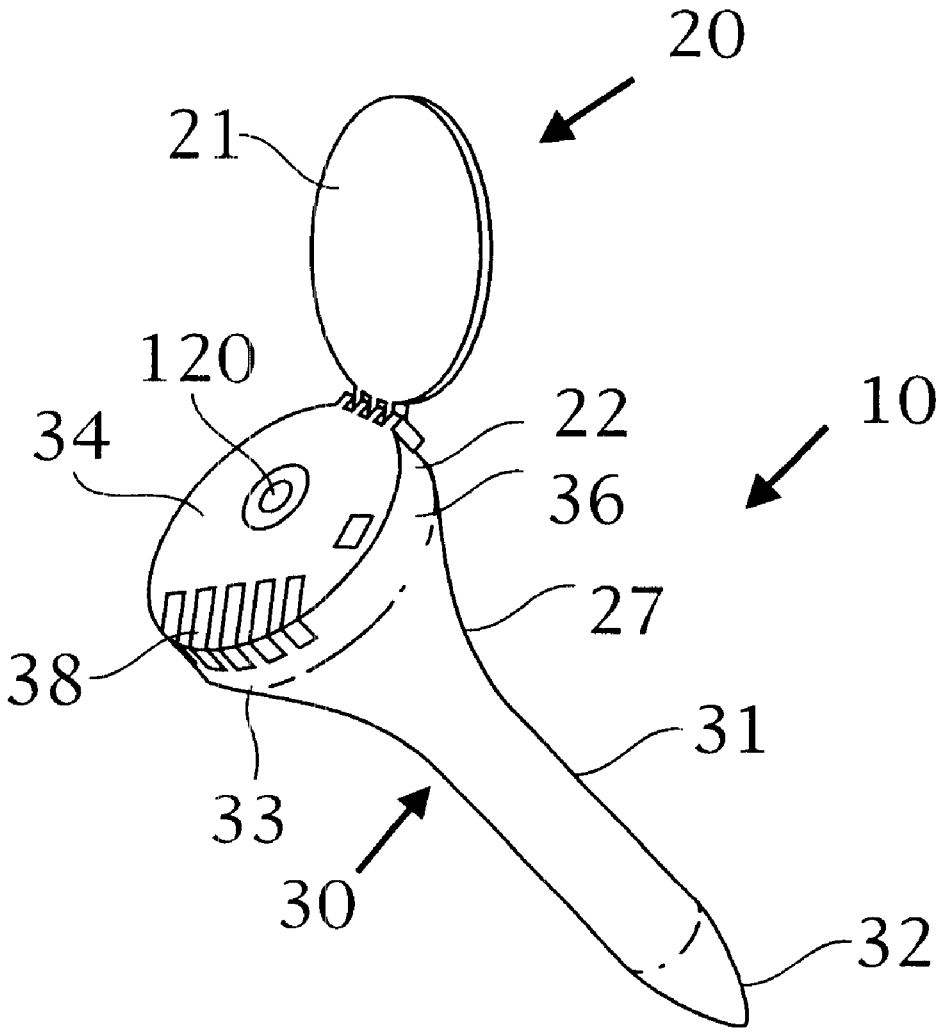
FIG. 4 is an oblique view drawing of a golf training device 10 according to a preferred embodiment of the present invention.

FIG. 4 is an oblique view drawing of a golf training device 10 according to a preferred embodiment of the present invention. Device 10 is generally in the shape of a standard golf tee and is amenable to being inserted in the turf in the manner of a golf tee. Such tees are familiar and unobtrusive articles on a golf course. Device 10 is of a size that securely houses and protects the required electronic circuitry and power source, and is preferably small enough to fit in the pocket of the golfer. Device 10 has a hinged cap portion 20 which protects all exposed components as will be described. The hinged stem of cap portion 20 can be used to arm the device when open, and to switch it off by closure when not in use. Closure of cap portion 20 also permits the golfer to press on the closed cap 20 in order to insert device 10 into the turf in the manner of a golf tee. The bottom face 21 of cap portion 20 is substantially flat and of sufficient size to cover the top face portion 34 of head portion 33 of the device body 30.

Figure 11:
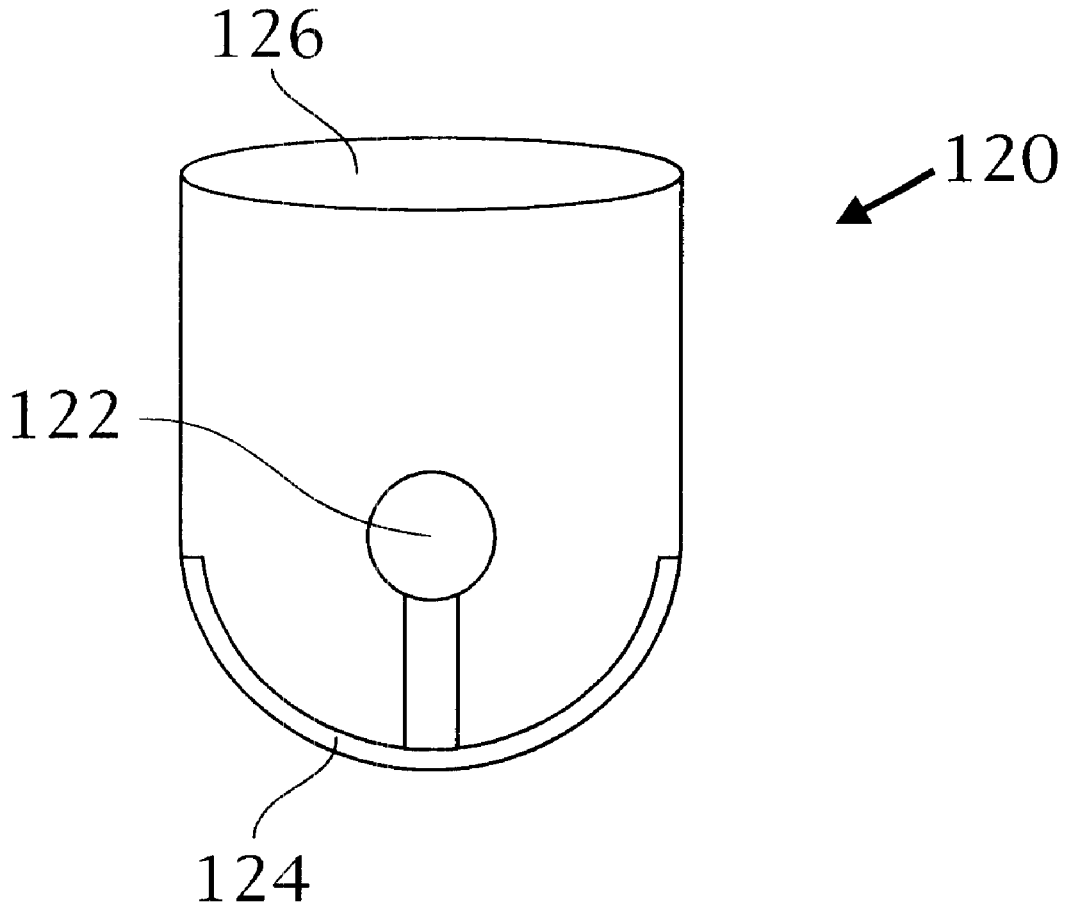
FIG. 11 is a side perspective view of an illuminating device 120 according to the present invention.

Device body 30 generally comprises a shaft portion 31 that culminates at its distal end in a point 32 that is sharp enough for application to the turf of a golf course, but not sharp enough to injure the user, in the manner of a standard golf tee. Device body 30 also comprises a head portion 33 integral to the other end of shaft portion 31, inside which the bulk of the required electronic circuitry is intended to reside. Access to the functions of the device 10 is through lifting the cap portion 20 to expose the top face portion 34. An aperture 36 in head portion 33 contains an illumination device 120, as shown in FIG. 11, which preferably consists of a light-emitting diode or incandescent bulb 122 with a limited-field-of-view reflector 124 and lens 126. Various conventional miniature illumination devices are well-suited for this task so long as they are capable of focusing the resultant pulse of light in the desired direction. Switch 37 turns the device on and off, and this can be manually operated to deactivate the device 10, or a pressure switch which closes when cap portion 20 is closed over top face portion 34. A grating 38 in head portion 33 contains a microphone (inside) which collects the sound stimulus that triggers the timer which activates the directed light pulse.

Figure 5:
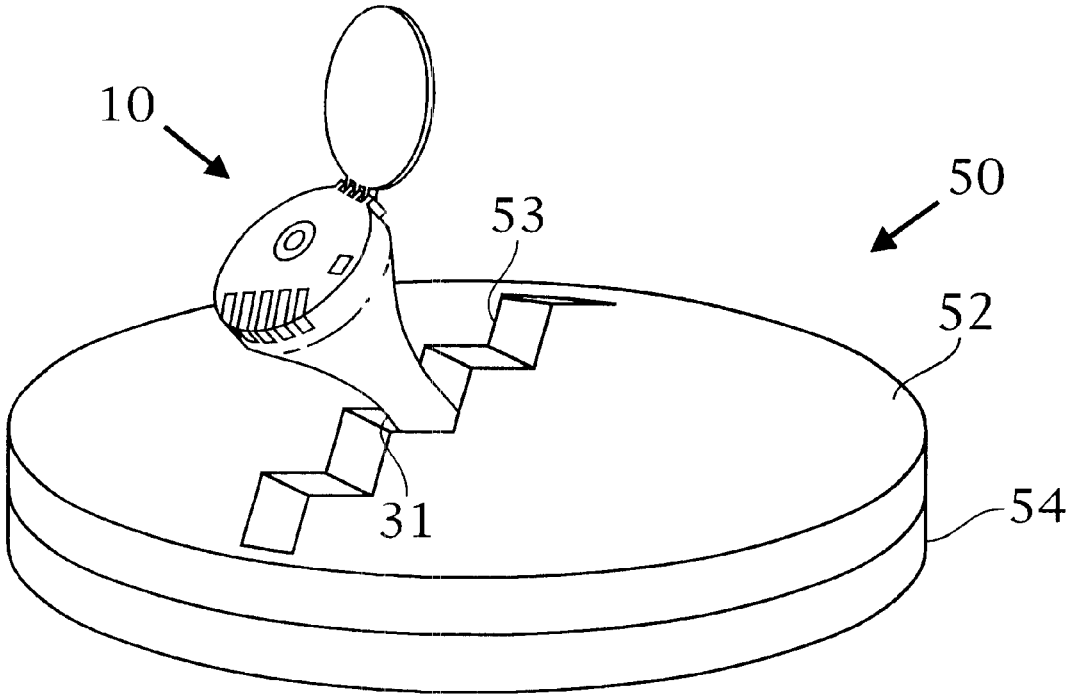
FIG. 5 is an oblique view drawing of the golf training device 10 of FIG. 4 in use with an optional base 50 according to a preferred embodiment of the present invention.

FIG. 5 is an oblique view drawing of the golf training device 10 of FIG. 4 in use with an optional base 50 according to the present invention. Base 50 is used in conjunction with the device 10 when insertion in the turf is not desired, or when the playing surface is not turf, such as on a driving range. Top portion 52 of base 50 is made of a firm, resilient material, and contains a corrugated slot 53 which accepts the shaft portion 31 of device body 30, for the purpose of holding it at the desired angle. Bottom portion 54 of base 50 is of a more rigid material and is of a weight that holds the base 50 steady. Base 50 is of a size that may be inconvenient to carry in the pocket of the golfer but is amenable to being placed in the golf bag, so that it may be used on the range or on the golf course in some circumstances.

Figure 6:
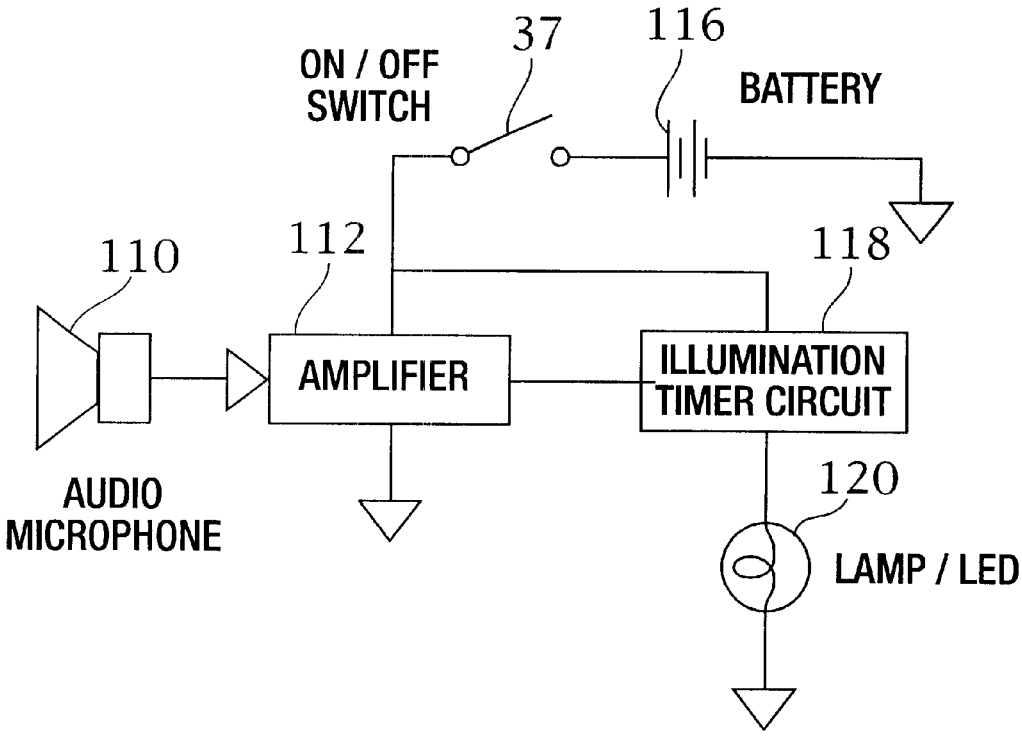
FIG. 6 is a diagram of the operating circuitry 100 of the golf training device 10 of FIG. 4.

FIG. 6 is a diagram of the operating circuitry 100 of the golf training device 10 of FIG. 4. Microphone 110 receives a sound impulse that corresponds to the contact of the club face with the ball or the club head with the playing surface. Either sound will denote the inception of the contact portion of the swing with reasonable accuracy. This sound is amplified by amplifier 112 to make a signal sufficient to be separated from background noise. This immediately lights illumination device 120 (immediately after club head contact), and it triggers a timer 118 to maintain illumination. The timer 118 lights illumination device 120 for an interval of time that allows the golfer to perceive the illumination if the eyes (and head) are positioned properly at club head contact. The circuit may be armed for sensing by switch 37 or any other means known in the art, and is powered by a battery 116 or other suitable power sources.

The proper use of the golf swing training device 10 according to the present invention will now be described with reference to FIGS. 7–9.

Figure 7:
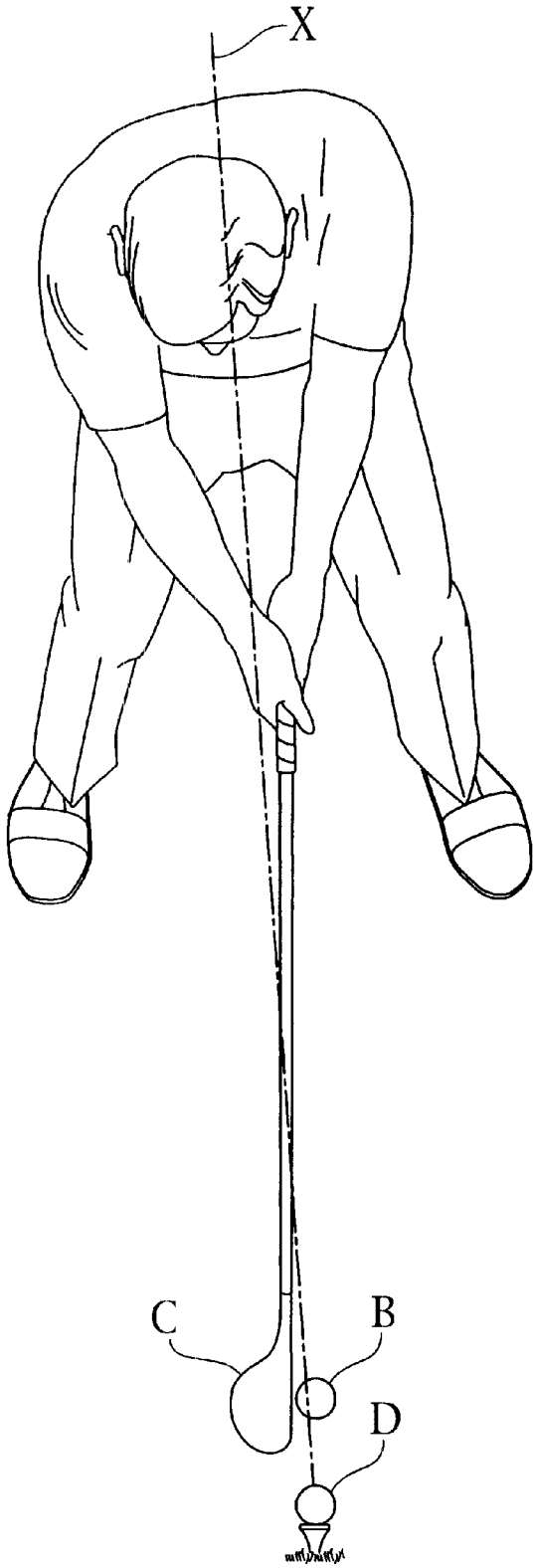
FIG. 7 is a top view rendering of a golfer in the position of addressing the ball with an exemplary configuration of training device 10 according to the present invention in use.

As seen in FIG. 7, the golf training device 10 is placed at position D in the plane formed by line X and the view point, as near as possible to ball B without interfering with the movement of club C during the swing, and also sufficiently far from ball B to prevent the player from compensating his or her swing out of caution for the device D.

Figure 8:
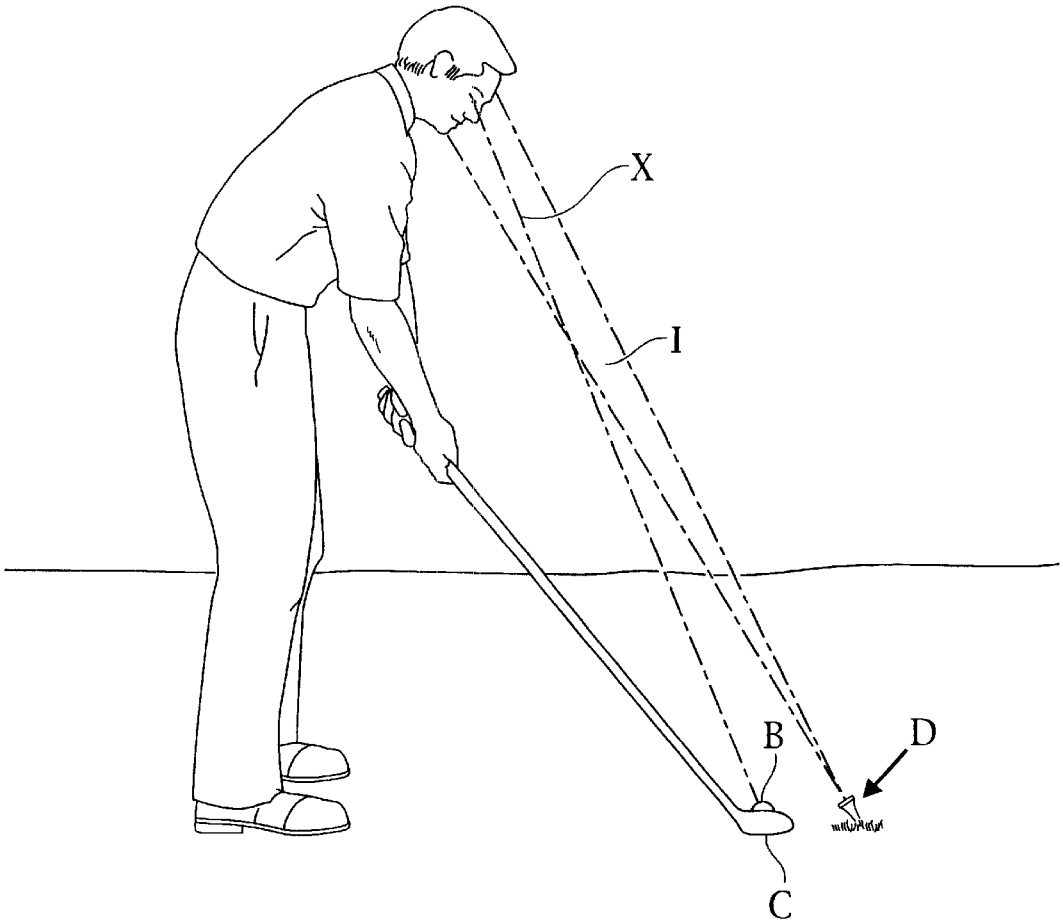
FIG. 8 is a plan view rendering of a golfer in the position of addressing the ball, showing the training device 10 as in FIG. 7.

Referring to FIG. 8, the device 10 is shown at position D a short distance from the ball B being addressed. The device 10 is oriented toward the golfer so that the pulse of directed light will travel generally at the face of the golfer. This alignment is significant because the light pulse is preferably only visible to the golfer when his/her eyes are generally maintaining, contact with the target at the point of club head contact.

Figure 9:
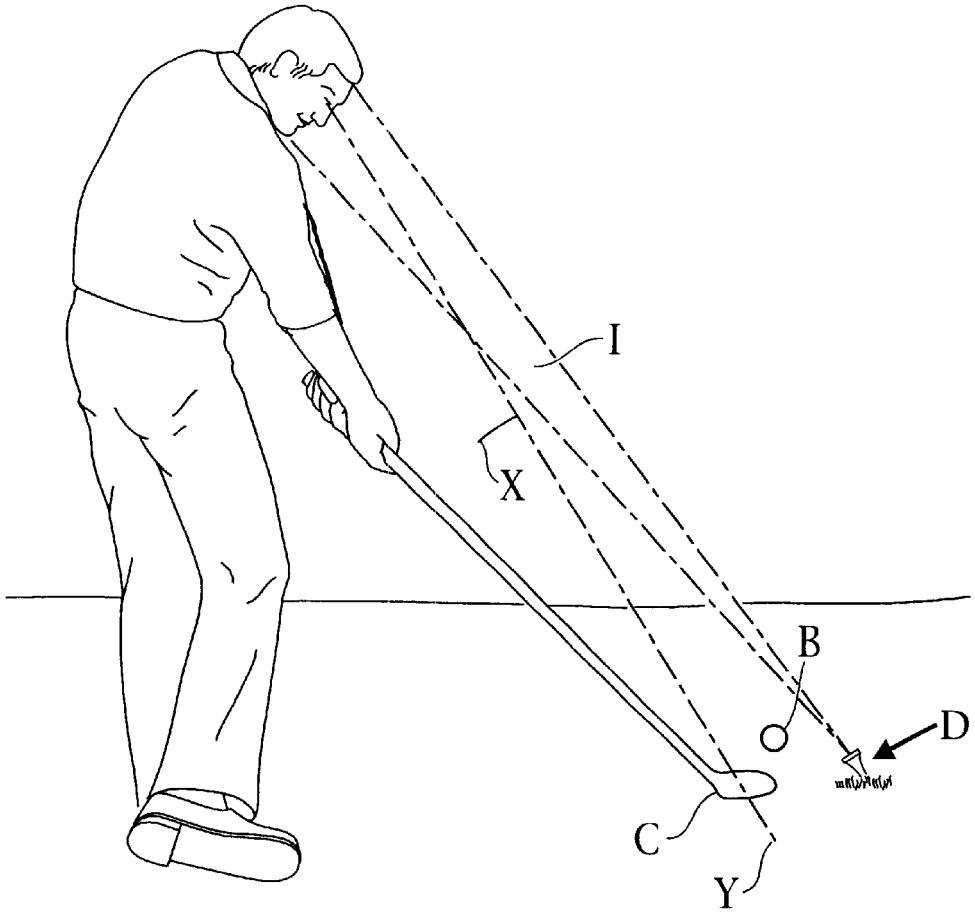
FIG. 9 is a plan view rendering of a golfer in the position of the early portion of the follow through, showing the training device 10 as in FIG. 7.

Referring to FIG. 9, when the golfer has completed the contact portion of the swing, signified by the ball B leaving the head of club C, and by the turning of the hips. At this point it is crucial for the head of the golfer to remain substantially along line X for a short time, because that is the best way to ensure the proper position and movement through the contact portion of the swing. This habit is reinforced by device 10 inasmuch as the light pulse begins immediately after club head contact and continues to be illuminated for a brief period following to allow the golfer to receive the illumination if his/her eyes are positioned properly at the target. The angle between line X and the arc of the directed light pulse 1 is sufficiently small to be effective. If the angle is too wide and/or illumination period too long the golfer may perceive the illumination even though the eyes have moved significantly from the target.

Continued use of the device tends to promote the correct muscle memory of a proper swing, making the learning experience a much shorter process. The device is a simple and effective way to automatically reinforce the correct configuration and position of the head during the golf swing.

Figure 10:
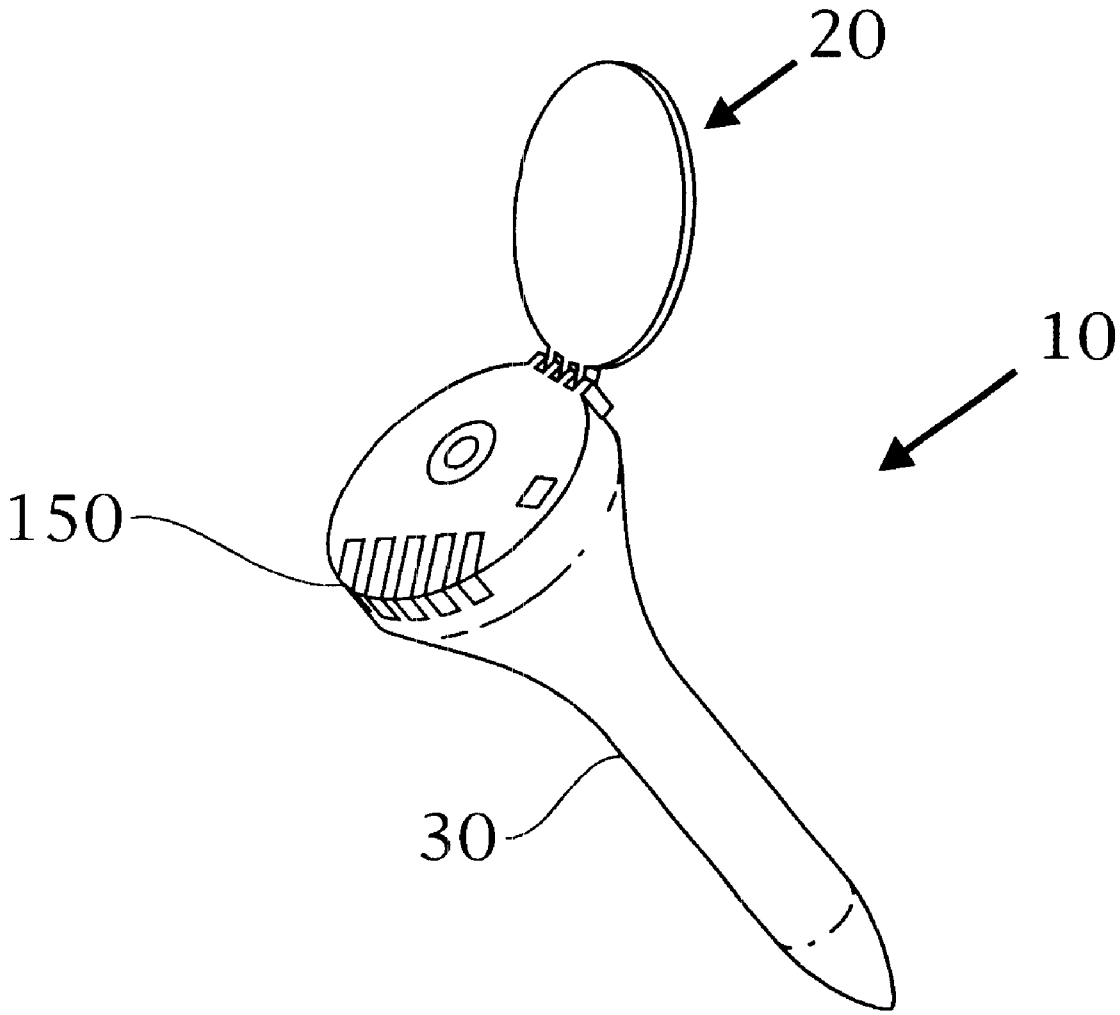
FIG. 10 is an oblique view drawing of a golf training device 10, showing a motion detector 150, according to an alternative embodiment of the present invention.

Having now fully set forth the preferred embodiments and certain modifications of tile concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein. By way of example, it is apparent to one of ordinary skill in the relevant art that the battery of the present invention may be a rechargeable battery, solar cell or external power source of known manufacture. By way of further example, it is apparent to one of ordinary skill in the relevant art that the configuration of the device need not be a golf tee, but may be any shape that rests on the playing or practice surface in a stable manner. It is also envisioned that the Microphone 110 and amplifier 112 can be replaced by a motion-detector 150 (as shown in FIG. 10) without departing from the scope and spirit of the invention. This way, the motion at the point of head contact will trigger the illumination device 120 and timer 118 to accomplish the same purpose.

I claim:

1. A golf swing training device for conditioning a golfer to keep his eye on a ball through the moment of club bead contact, comprising:

a sensing circuit for detecting club head contact with the ball;

a timer connected to the sensing circuit for timing a predetermined interval after club head contact;

a light indicator connected to said timer for visually indicating expiration of said interval to said golfer; and a rigid housing for containing and protecting said sensing circuit, timer and indicator said housing being adapted for remote placement from the golfer near the ball such that said light indicator remains in the golfer's peripheral vision during the golfer's swing.

2. The golf swing training device according to claim 1, wherein said indicator further comprises a light for transmitting visual feedback to the golfer a predetermined interval after said impact.

3. The golf swing training device according to claim 2, wherein said sensing circuit further comprises a microphone for detecting a sound of impact made by club head contact.

4. The golf swing training device according to claim 3, wherein said sensing circuit further comprises an amplifier connected to said microphone for amplifying a sound signal there from with respect to background noise.

5. A golf swing training device for conditioning a golfer to keep his eye on a ball through the moment of club head contact, comprising:

a motion detector for detecting motion at a point of club head contact;

a light indicator connected to said motion detector for visually indicating motion at a point of club head contact to said golfer; and a rigid housing for containing and protecting said motion detector and indicator, said housing being adapted for remote placement from the golfer near the ball such that said light indicator remains in the golfer's peripheral vision during the golfer's swing.

6. A golf swing training device for providing positive visual feedback for a golfer to encourage proper head position, comprising:

a microphone for detecting a sound of impact made by club head contact;

an illumination device for providing a visual stimulus;

a timer coupled between said microphone and said illumination device for illuminating said illumination device upon detecting the sound of impact made by club head contact, and for maintaining illumination for a predetermined time interval; and a housing for containing and protecting said microphone, said illumination device, said timer, and said housing being adapted for placement near the ball in front of the golfer such that said light indicator remains in the golfer's peripheral vision during said golfer's swing.

7. The golf swing training device according to claim 6, wherein said illumination device further comprises a light-emitting diode.

8. The golf swing training device according to claim 6, wherein said illumination device further comprises an incandescent bulb.

9. The golf swing timing device according to claim 7, wherein said illumination device further comprises a focused reflector.

10. The golf swing training device according to claim 9, wherein said illumination device further comprises a focusing lens.

11. The golf swing training device according to claim 6, wherein said housing is tee-shaped and further comprises a head section leading to a tapered stem, and a hinged cap closable on said head section for containing and protecting said microphone and illumination device.

12. The golf swing training device according to claim 11, wherein said hinged cap further comprises a pressure switch to activate said device when said cap is opened and to deactivate said device when said cap is closed.

13. The golf swing training device according to claim 6, further comprising a freestanding base with a notch for insertion of said housing.

14. The golf swing training device according to claim 13, wherein said notch is corrugated to facilitate insertion of said housing.

15. A method of conditioning a golfer to keep his eye on a ball through the moment of golf club head contact, comprising:

arming a swing training device and placing said swing training device on the ground proximate a ball to be hit, said swing training device including a sensing circuit for detecting club head contact and an indicator coupled to said sensing circuit for providing a visual indication to the golfer upon club head contact with the ball;

swinging at the ball with the golf club and attempting to maintain eye contact with the target until after the swing training device has provided said device's visual indication to the golfer.

* * * * *